US009440337B2

(12) United States Patent
Huang

(10) Patent No.: US 9,440,337 B2
(45) Date of Patent: Sep. 13, 2016

(54) PIPE WRENCH

(71) Applicant: Yu-Shiang Huang, Taichung (TW)

(72) Inventor: Yu-Shiang Huang, Taichung (TW)

( * ) Notice: Subject to any disclaimer, the term of this patent is extended or adjusted under 35 U.S.C. 154(b) by 295 days.

(21) Appl. No.: 14/301,354

(22) Filed: Jun. 11, 2014

(65) Prior Publication Data

US 2015/0143963 A1 May 28, 2015

(30) Foreign Application Priority Data

Nov. 25, 2013 (TW) ..... 102142747 A

(51) Int. Cl.

| | |
|---|---|
| ***B25B 13/50*** | (2006.01) |
| ***B25B 13/08*** | (2006.01) |
| ***B25B 13/18*** | (2006.01) |
| ***B25B 13/16*** | (2006.01) |

(52) U.S. Cl.

CPC ..... *B25B 13/5058* (2013.01); *B25B 13/16* (2013.01); *B25B 13/18* (2013.01)

(58) Field of Classification Search

CPC . B25B 13/505; B25B 13/5058; B25B 13/18; B25B 13/16

See application file for complete search history.

(56) References Cited

U.S. PATENT DOCUMENTS 539,012 A * 5/1895 Smith ..... B25B 13/18 81/356
1,155,948 A * 10/1915 Millsap, Jr. ..... B25B 13/18 81/171
1,354,494 A * 10/1920 King ..... B25B 13/18 81/134
2,379,107 A * 6/1945 Scheck ..... B25B 7/123 269/208
2,452,625 A * 11/1948 Alpers ..... B25B 7/123 81/375
2,471,734 A * 5/1949 Fischer ..... B25B 7/123 81/356
2,772,591 A * 12/1956 Munroe ..... B25B 13/16 81/167
3,340,754 A * 9/1967 Burchett ..... B25B 7/12 81/356
3,564,956 A * 2/1971 Landon ..... B25B 7/123 81/126
4,477,937 A * 10/1984 Costello ..... B25B 13/26 7/139
4,616,536 A * 10/1986 Knebel ..... B25B 13/16 81/128
5,094,132 A * 3/1992 Engel ..... B25B 13/18 81/356
5,138,912 A * 8/1992 Dyke ..... B25B 7/123 81/356
5,832,793 A * 11/1998 Collins ..... B25B 13/5058 81/138
8,925,426 B2 * 1/2015 Shishkin ..... B25B 13/18 81/129

* cited by examiner

*Primary Examiner* — David B Thomas

(57) ABSTRACT

A pipe wrench includes a body and a first jaw has one end fixed to the body, and a second jaw is slidably located in a first recess defined in the top of the body and is located beneath the first jaw. A resilient member is connected between the body and the second jaw. A first link has one end pivotably connected to an end of the second jaw. A second link has the first end thereof pivotably connected to the mediate portion of the first link. An adjustment member threadedly extends through a closed end of the body and contacts against the second end of the second link. The second jaw is quickly slid by the resilient member and controlled by the adjustment member, so that the object can be released and clamped quickly.

12 Claims, 10 Drawing Sheets

PIPE WRENCH

BACKGROUND OF THE INVENTION

1. Fields of the Invention

The present invention relates to a pipe wrench, and more particularly, to a pipe wrench with a resilient member connected to the second jaw and with an adjustment member to adjust the second jaw.

2. Descriptions of Related Art

The conventional pipe wrench is disclosed in U.S. Pat. No. 351,656 and comprises a first body shaped as a handle, and the first body has a first pivotal portion. A first jaw has a first end pivotably connected to the first body. A second jaw is slidably connected to the first jaw. A link has one end pivotably connected to the second jaw, and the mediate portion of the link is pivotably connected to the first pivotal portion of the first body. The user operates the link to move the second jaw to clamp the object. However, when the second jaw is moved, and the first jaw and the second jaw are rotated to rotate the object an angle, the first and second jaws have to be removed from the object, and then clamp the object from another angular position. The frequent releasing and clamping actions takes a lot of time.

The present invention intends to provide a pipe wrench which eliminates the shortcomings mentioned above.

SUMMARY OF THE INVENTION

The present invention relates to a pipe wrench and includes a body and a first jaw which has one end fixed to the body, and a second jaw is slidably located in a first recess defined in the top of the body and is located beneath the first jaw. A resilient member is connected between the body and the second jaw. A first link has one end pivotably connected to an end of the second jaw. A second link has the first end thereof pivotably connected to the mediate portion of the first link. An adjustment member threadedly extends through a closed end of the body and contacts against the second end of the second link. The second jaw is quickly slid by the resilient member and controlled by the adjustment member, so that the object can be released and clamped quickly.

The primary object of the present invention is to provide a pipe wrench wherein the object is firmly clamped by the first and second jaws by using the adjustment member to contact against the second jaw.

Another object of the present invention is to provide a pipe wrench wherein the pipe wrench does not have to remove from the object before re-clamping the object.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
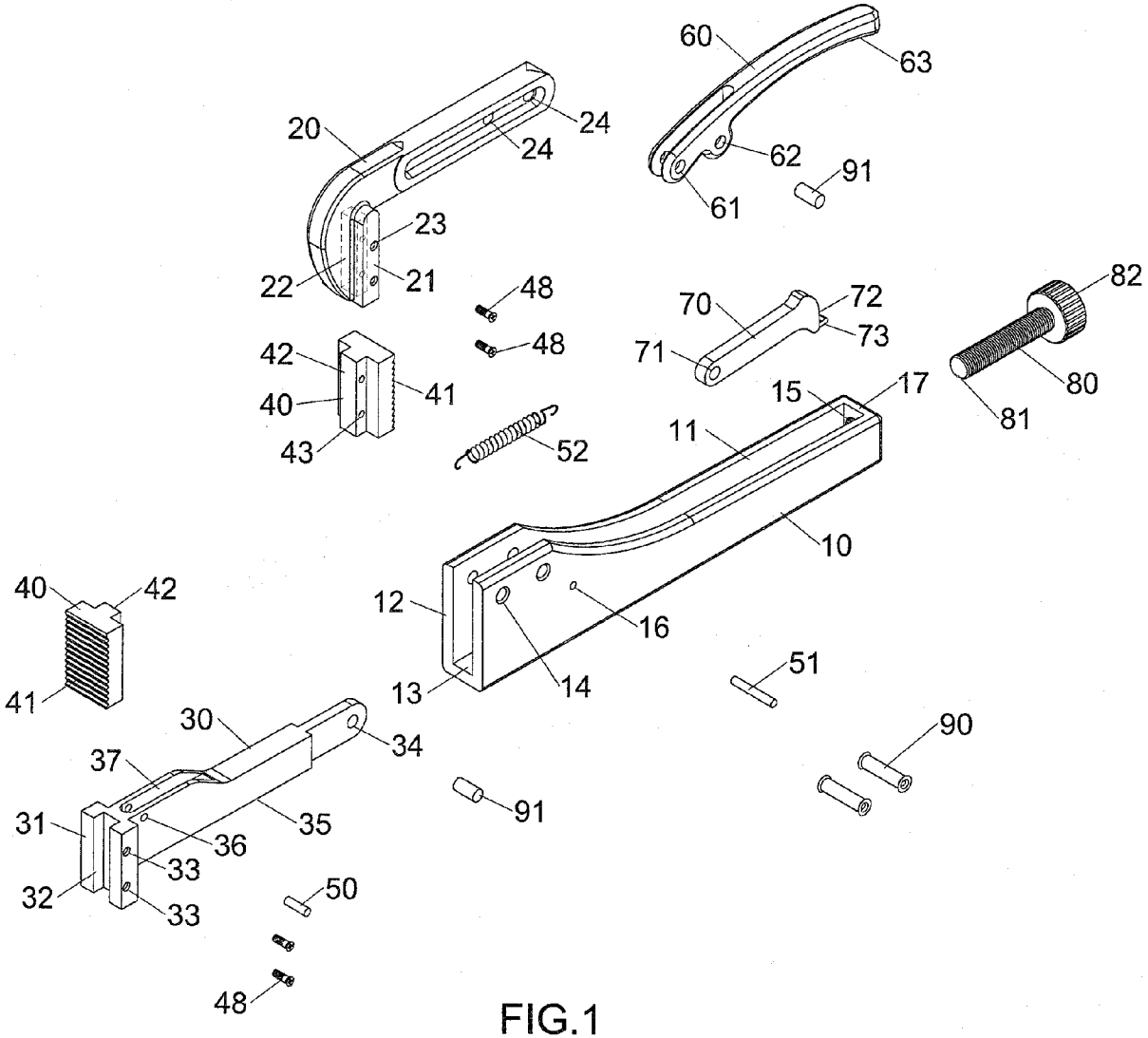
FIG. 1 is an exploded view of the pipe wrench of the present invention.

Referring to FIG. 1, the first embodiment of the pipe wrench of the present invention comprises a body 10, a first jaw 20, a second jaw 30, at least one clamp member 40, multiple connectors 80, a first pin 50, a second pin 51, a resilient member 52, a first link 60, a second link 70, an adjustment member 80, multiple fixing members 90 and multiple pins 91.

The body 10 comprises a first recess 11 defined in the top thereof, and the body 10 has an open end 12 defined in the first end thereof, and a closed end formed at the second end thereof. A first contact portion 17 is located at the closed end. The body 10 has two sidewalls and a first contact face 13 connected between the two sidewalls. The first recess 11 is defined between the two sidewalls and the first contact face 13. The open end 12 communicates with the first recess 11. A first aperture 16 and two first holes 14 are defined through each of the two sidewalls and located close to the open end 12. A threaded hole 15 is defined through the first contact portion 17.

The first jaw 20 is an L-shaped jaw and has a first end fixed to the body 10. A portion of the first jaw 20 is located in the first recess 11. A second end of the first jaw 20 is connected with a first connection portion 21. The first connection portion 21 has a first slot 22 which is defined by two sidewalls, one of the two sidewalls of the first slot 22 has multiple first connection holes 23 which communicate with the first slot 22. The first jaw 20 has multiple second holes 24 which are located in alignment with the first holes 14.

The second jaw 30 is an elongate member and has a second connection portion 31 at the first end thereof, and a first pivotal portion 34 is formed on the second end of the second jaw 30. A second contact face 35 is defined at the underside of the second jaw 30. The second connection portion 31 has a second slot 32 which is defined by two sidewalls, one of the two sidewalls of the second slot 32 has multiple second connection holes 33 which communicate with the second slot 32. The second jaw 30 is slidably received in the first recess 11 and located beneath the first jaw 20. The second contact face 35 is in contact with the first contact face 13. The second jaw 30 has a second recess 37 defined in the top thereof. A second aperture 36 is defined through each of two sidewalls of the second recess 37. The second apertures 36 communicates with the second recess 37.

Two clamp members 40 are respectively connected to the first connection portion 21 and the second connection portion 31. The two clamp members 40 each are a T-shaped member. Each clamp member 40 has a third connection portion 42 extending from the first face thereof. The two respective third connection portions 42 of the two clamp members 40 are connected to the first and second slots 22, 32. Each of the third connection portions 42 has multiple third connection holes 43. Multiple connectors 48 extend through the aligned first and third connection holes 23, 43 and the aligned second and third connection holes 33, 43 to connect the clamp members 40 to the first and second connection portions 21, 31 respectively. In this embodiment, the first and second connection holes 23, 33 are threaded holes, and the connectors 48 are bolts. Each clamp member 40 has a toothed face 41 formed on the second face thereof. The second face is located in opposite to the first face. Each of the toothed faces 41 has multiple transverse teeth.

The first pin 50 extends through the second apertures 36 of the second jaw 30, and the second pin 51 extends through the first apertures 16 of the body 10. In this embodiment, the first pin 50 is tightly connected to the two second apertures 36, and the second pin 51 is tightly connected to the two first apertures 16.

The resilient member 52 is located in the second recess 37 and has a hook at each end so as to be connected between the first pin 50 of the second jaw 30 and the second pin 51 of the body 10 so that the second jaw 30 is moved linearly in the first recess 11.

The first link 60 has a second pivotal portion 61 and a second contact portion 63 on two ends thereof. A third pivotal portion 62 is formed at the mediate portion of the first link 60. The second pivotal portion 61 is pivotally connected to the first pivotal portion 34, and the second contact portion 63 contacts the first contact portion 17.

The second link 70 is slidably located in the first recess 11. A fourth pivotal portion 71 and an end face 72 are respectively formed on two ends of the second link 70. The fourth pivotal portion 71 is pivotably connected to the third pivotal portion 62. A protrusion 73 extends from the lower edge of the end face 72 and contacts the first contact face 13.

The adjustment member 80 is threadedly connected to the threaded hole 15 and has a head 82 and a threaded shank extends from the head 82. The threaded shank has a distal end 81 which contacts the end face 72 of the second link 70. The protrusion 73 is restricted by the distal end 81 of the adjustment member 80. The end face 72 of the second link 70 contacts the first contact face 13. The head 82 protrudes from the body 10 so that the user can rotate the head 82 conveniently.

A pin 91 extends through the first and second pivotal portions 34, 61, and another pin 91 extends through the third and fourth pivotal portions 62, 71 to connect the second jaw 30, the first link 60 and the second link 70 in sequence.

Figure 2:
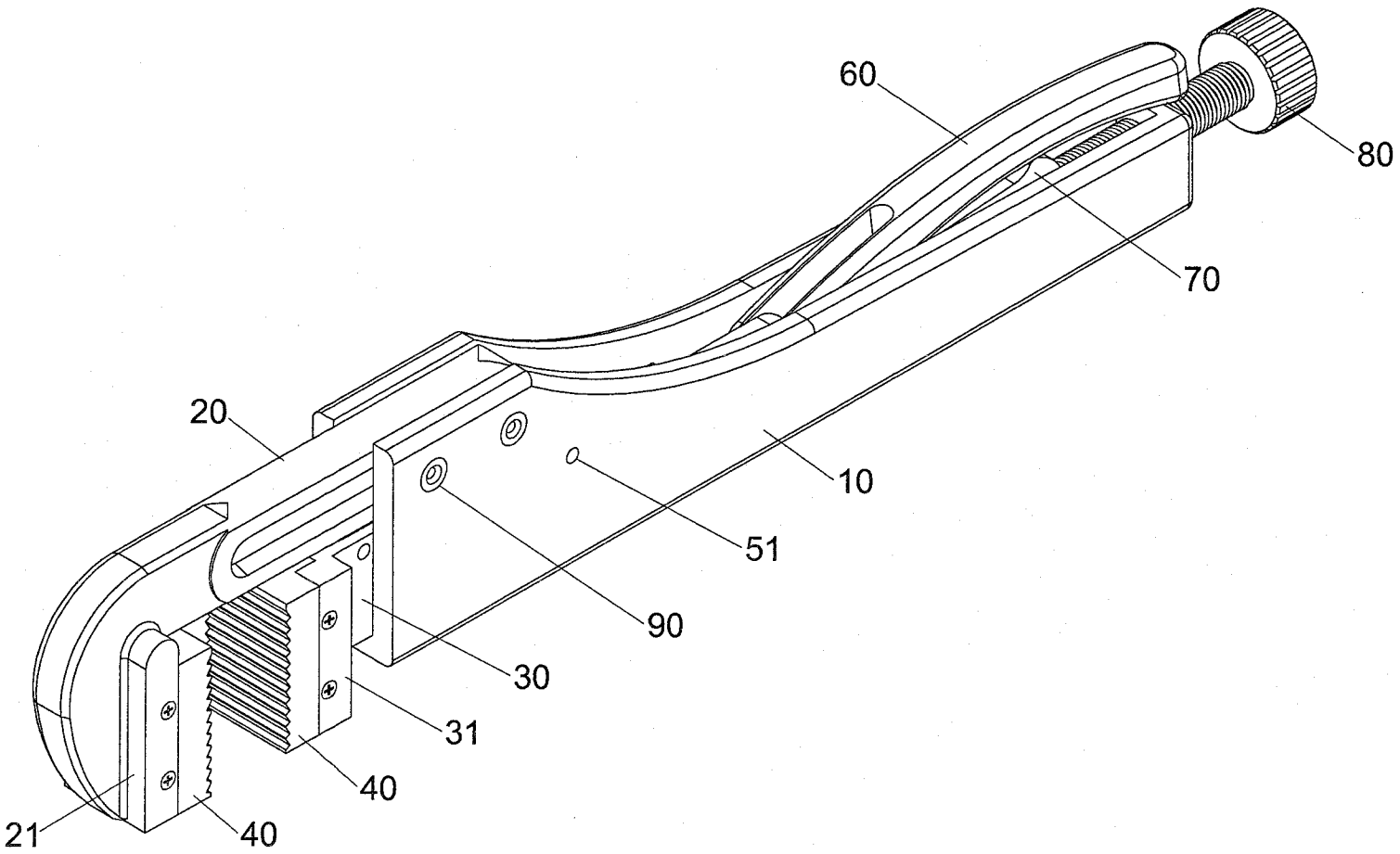
FIG. 2 is a perspective view to show the pipe wrench of the present invention.

As shown in FIG. 2, the second jaw 30, the second and third pivotal portions 61, 62 of the first link 60, and the second link 70 are located in the first recess 11. The second contact face 35 contacts the first contact face 13. The second contact portion 63 protrudes from the first recess 11 and contacts the first contact portion 17. The fixing member 90 extends through the first and second holes 14, 24 to connect the first jaw 20 to the body 10. The second jaw 30 is restricted by the first jaw 20 so that the second jaw 30 can only move linearly in the first recess 11. The connectors 48 connect the two clamp members 40 to the first and second connection portions 21, 31 respectively. The adjustment member 80 threadedly extends through the threaded hole 15, and the distal end 81 contacts the end face 72.

Figure 3:
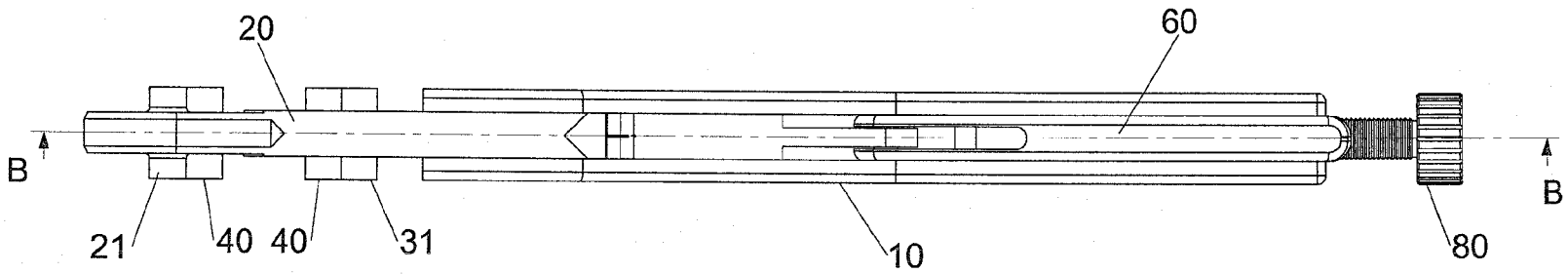
FIG. 3 is a top view to show the pipe wrench of the present invention.
Figure 4:
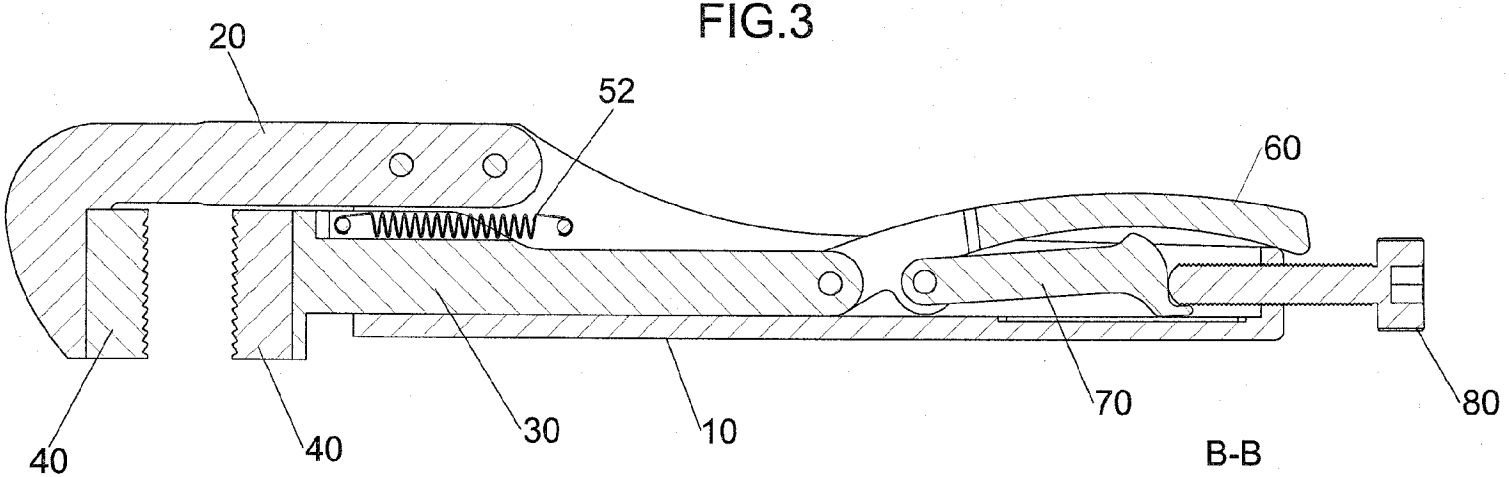
FIG. 4 is a cross sectional view, taken along line B-B in FIG. 3.

As shown in FIGS. 3 and 4, the two hooks of the resilient member 52 respectively hook to the first and second pins 50, 51. The resilient member 52 is located in the first recess 11. The second jaw 30, the second and third pivotal portions 61, 62 and the second link 70 are located in the first recess 11. The second jaw 30 is restricted by the first jaw 20, the second jaw 30 can only move linearly on the first contact face 13. The adjustment member 80 is threadedly connected to the threaded hole 15 and the distal end 81 contacts the end face 72 of the second link 70. The second contact portion 63 contacts the first contact portion 17. The connection relationship between the first link 60, the second link 70 and the second jaw 30 makes the second jaw 30 and the second link 70 be firmly positioned. An object 92 is clamped between the two clamp members 40.

Figure 5:
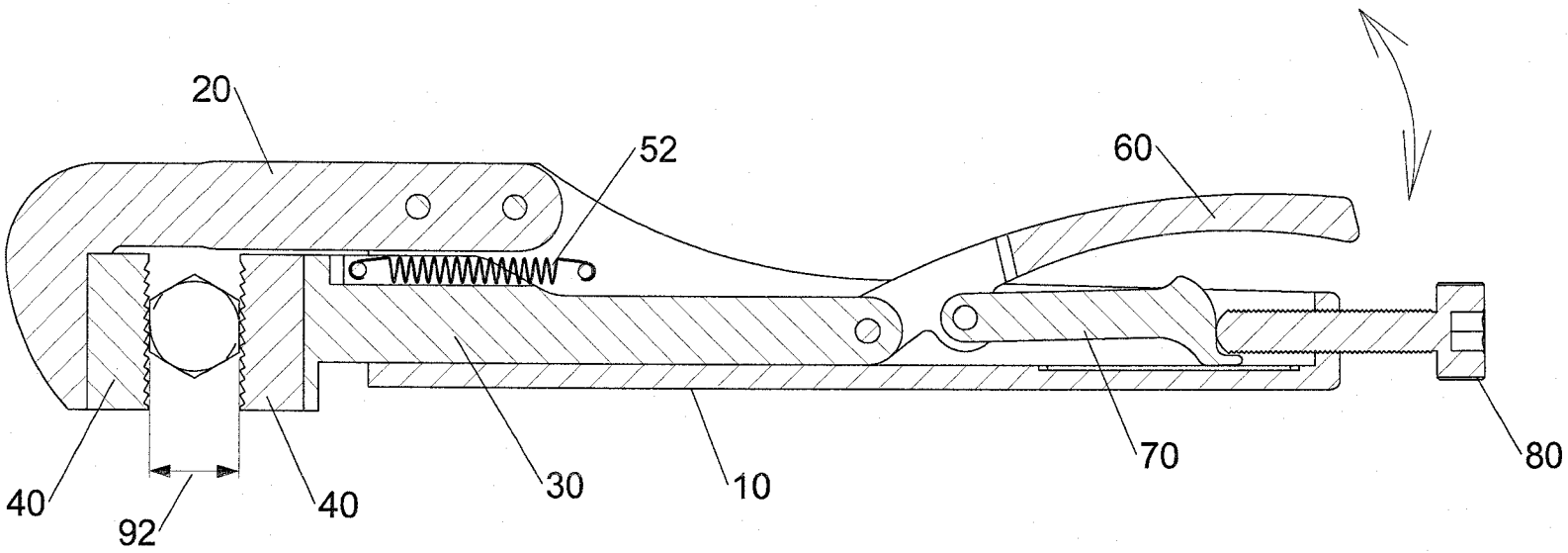
FIG. 5 shows that an object is clamped by the pipe wrench of the present invention.
Figure 6:
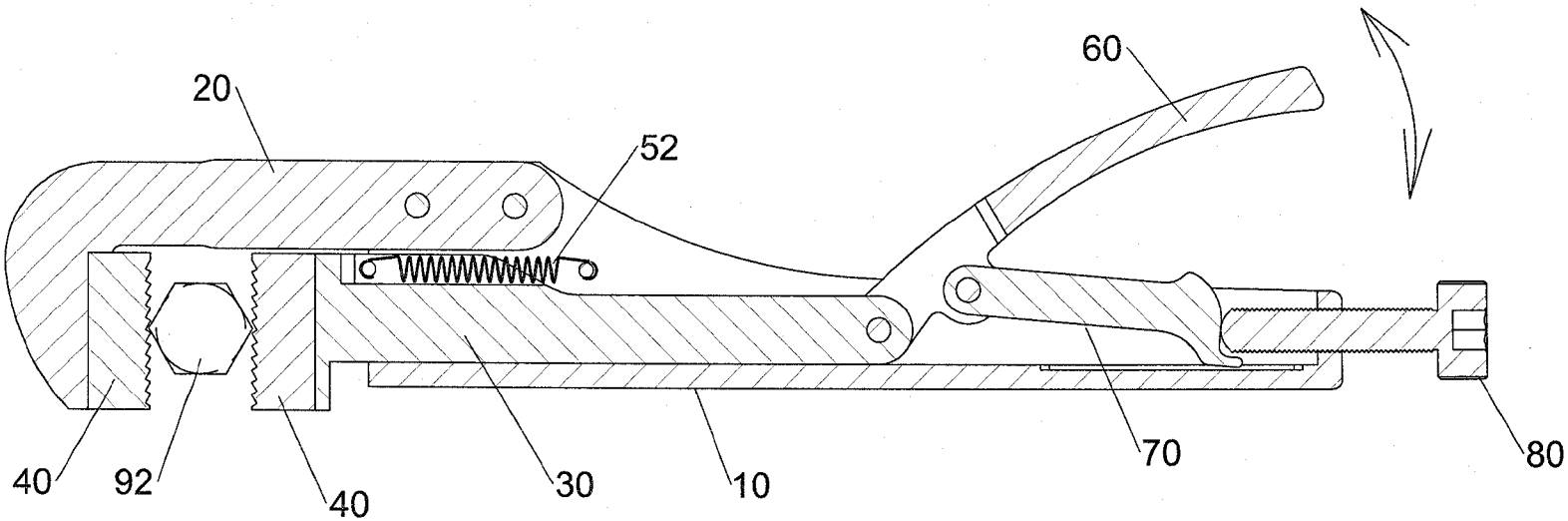
FIG. 6 is another view to show that the first link is pivoted upward.

As shown in FIGS. 5 and 6, by pivoting the first link 60, the second contact portion 63 does not contact the first contact portion 17, the user holds the first link 60 and the body 10 to rotate the object 92 which is clamped by the two clamp members 40 which are positioned by the first link 60, the second link 70 and the second jaw 30. When the user releases the second link 60 slightly as shown In FIG. 6, because the resilient member 52, the second jaw 30 automatically moves back, so that the distance between the two clamp members 40 allows the corners of the object 92 to pass. In other words, the pipe wrench has a function similar to the ratchet mechanism, the object 92 does not have to be completely removed from the pipe wrench and can be re-clamped again quickly.

Figure 7:
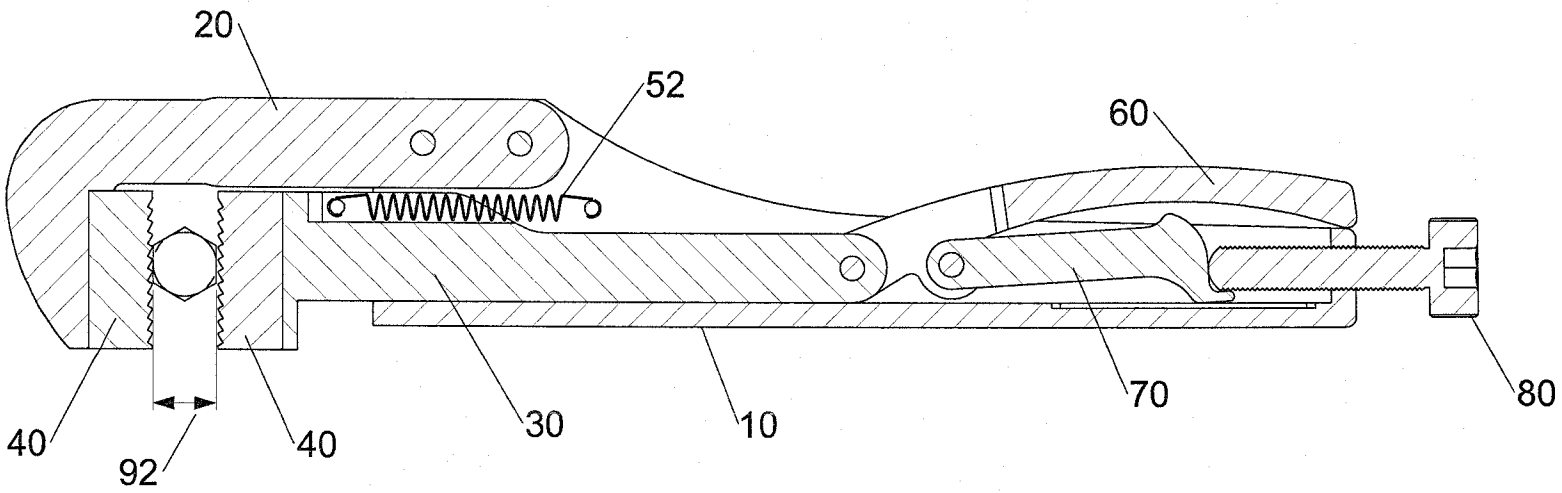
FIG. 7 shows that the adjustment member moves the second jaw forward.

FIG. 7 shows that the adjustment member 80 is threadedly connected to the threaded hole 15 and the distal end 81 contacts the end face 72 of the second link 70. The protrusion 73 is restricted by the distal end 81 of the adjustment member 80. When rotating the adjustment member 80, the second link 70, the first link 60 and the second jaw 30 are moved so as to clamp another object 92 of a different size. The adjustment member 80 adjusts the clamp force to the object 92.

As shown in FIGS. 4 to 7, after the adjustment member 80 is rotated, the object 92 such as the 19 mm object is clamped. Because the user holds the first link 60 and the body 10, the first link 60 is pivoted an angle, the object 92 with 19 mm to 24 mm can be normally clamped. When the first link 60 is pivoted 10 to 15 degrees relative to the body 10, the object 92 of 20 mm can be clamped and rotated, and performs like using a ratchet wrench. When the first link 60 is pivoted 15 to 20 degrees relative to the body 10, the object 92 of 21 mm can be clamped and rotated, and performs like using a ratchet wrench. As shown in FIGS. 5 and 6, the pipe wrench clamps and rotates the object 92 normally like a ratchet wrench. When the adjustment member 80 is adjusted to clamp the object 92 of 22 mm, any object has the size of 22 mm to 27 mm can be clamped normally. If the user wants to firmly clamp the object instead of normal clamp, the adjustment member 80 is operated to adjust one scale of the size mentioned above. If the user wants to clamp the object normally, the adjustment member 80 is operated to adjust within the size range mentioned above.

Figure 8:
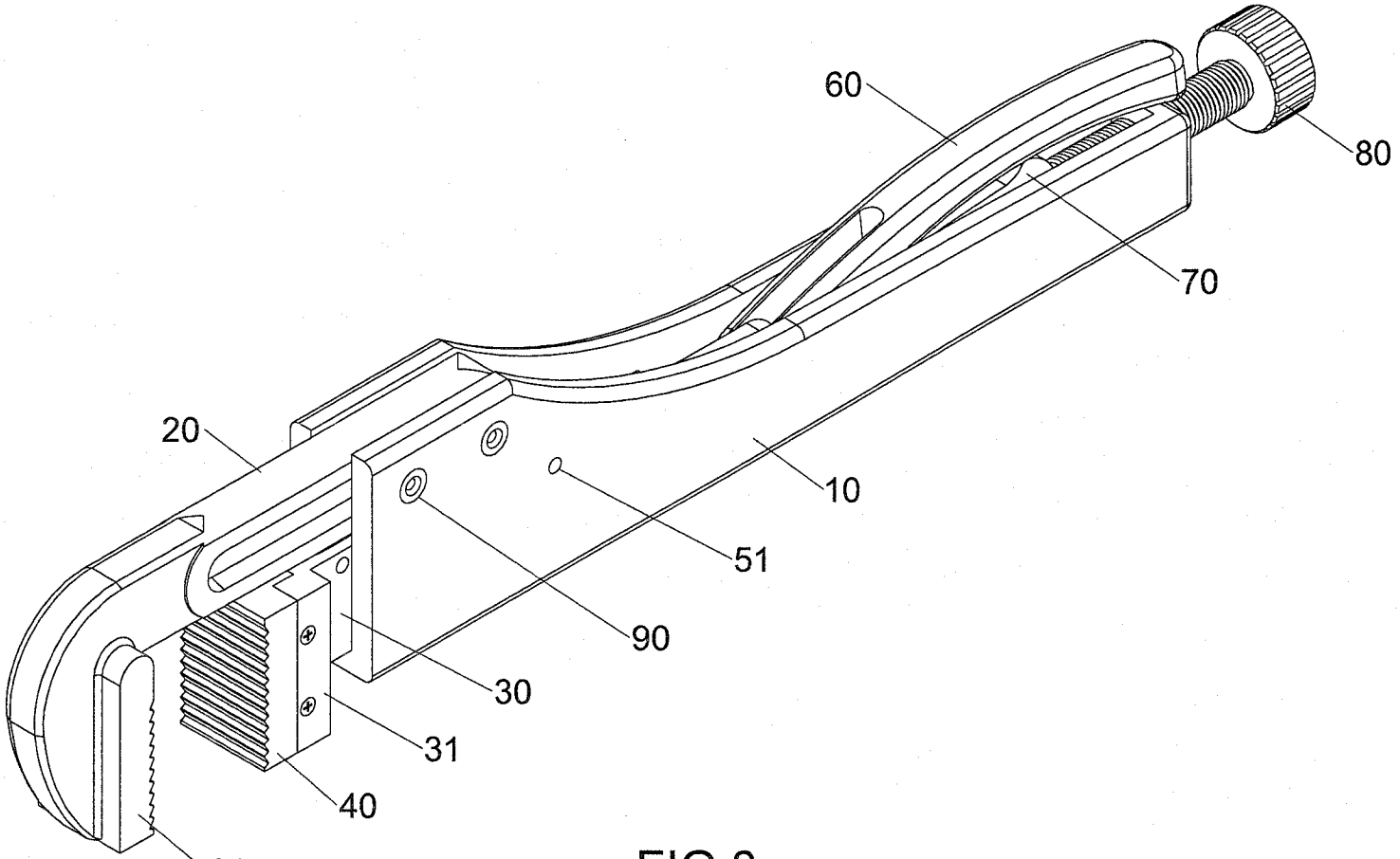
FIG. 8 is a perspective view to show the second embodiment of the pipe wrench of the present invention.
Figure 9:
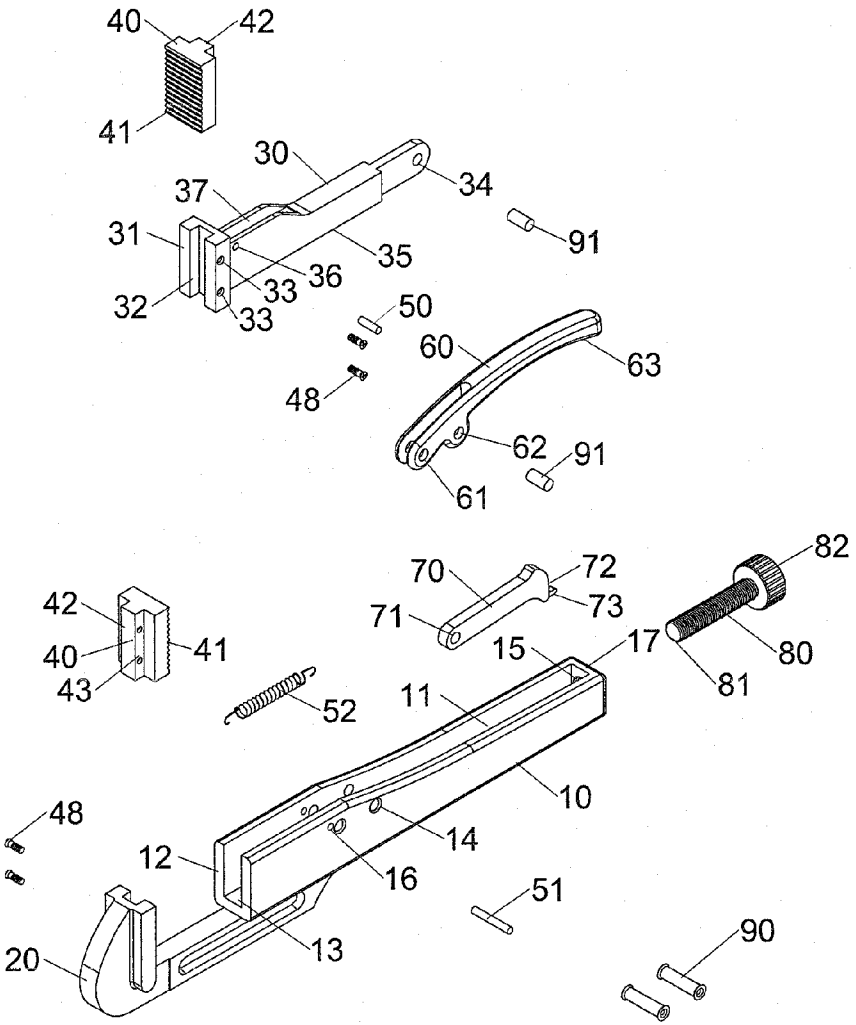
FIG. 9 is an exploded view of the third embodiment of the pipe wrench of the present invention.
Figure 10:
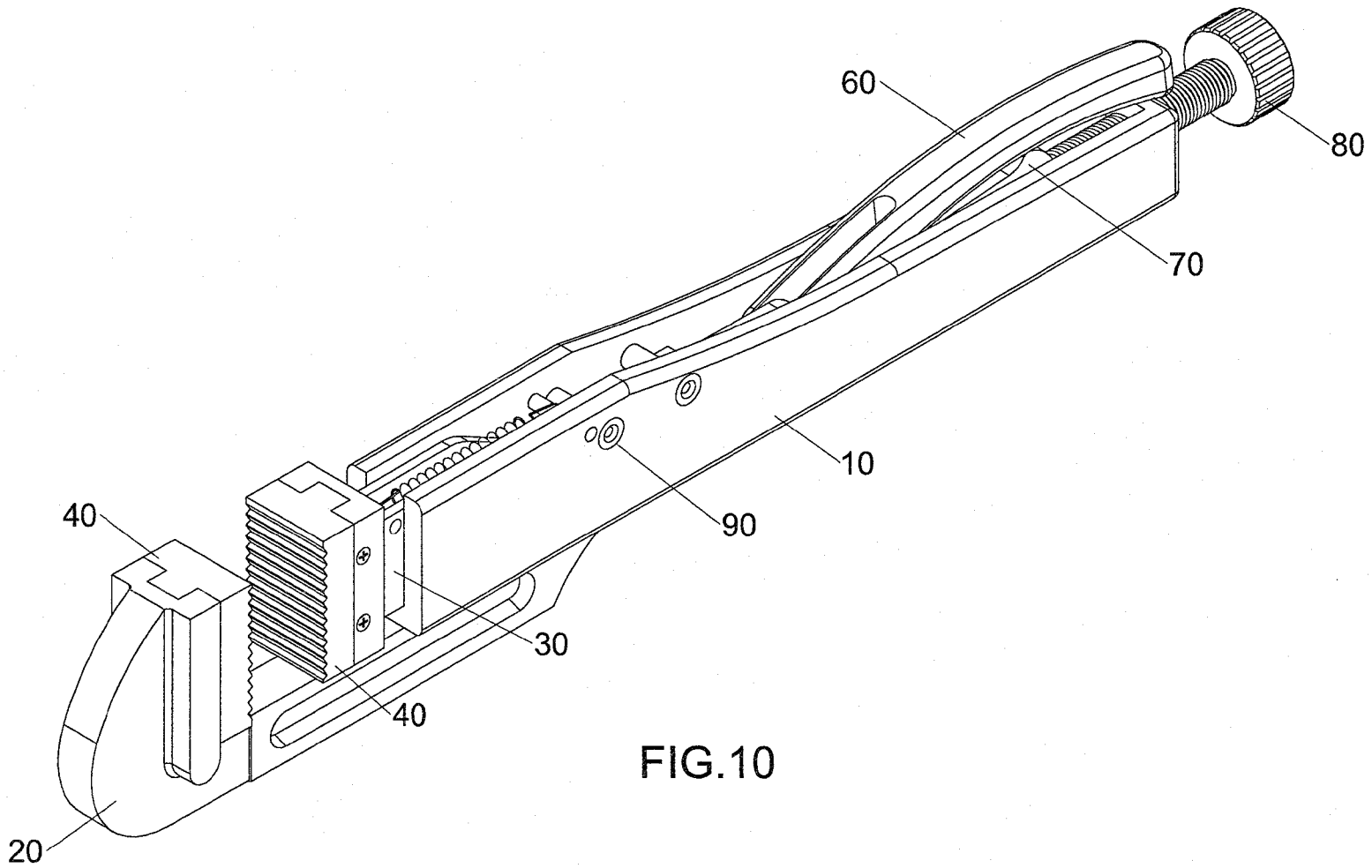
FIG. 10 is a perspective view to show the third embodiment of the pipe wrench of the present invention.
Figure 11:
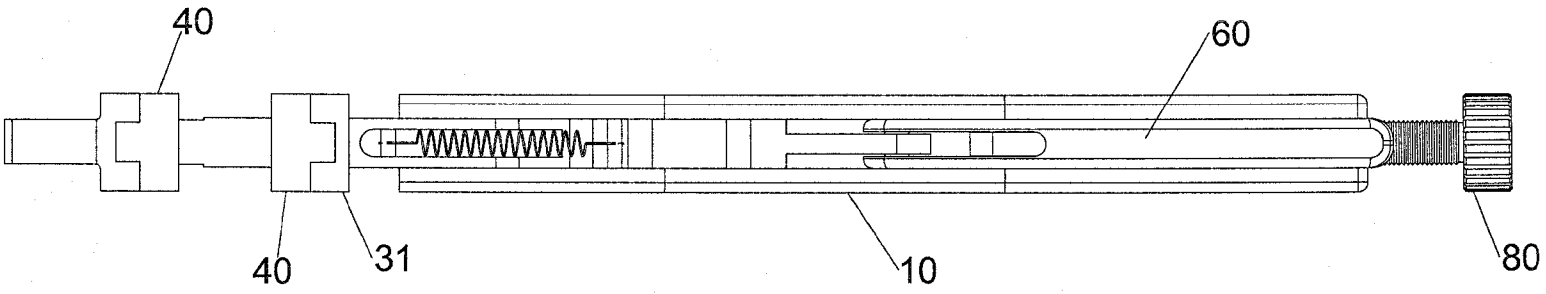
FIG. 11 is a top view of the third embodiment of the pipe wrench of the present invention.
Figure 12:
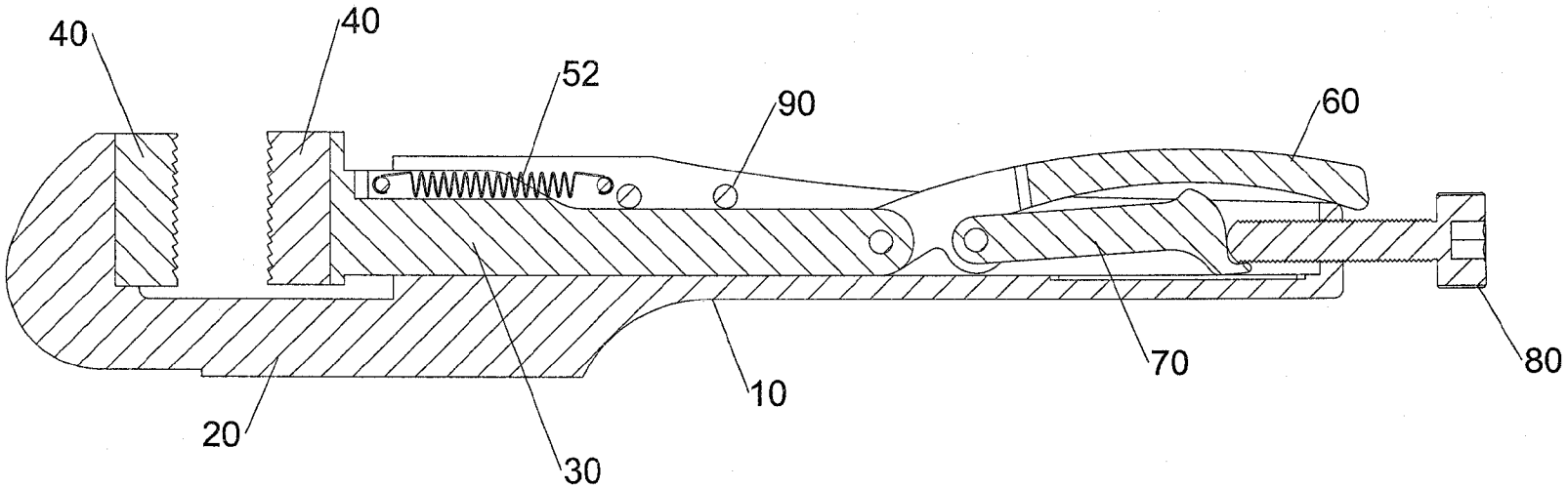
FIG. 12 is a cross sectional view to show the third embodiment of the pipe wrench of the present invention.

FIG. 8 shows the second embodiment, the first connection portion 21 and the clamp member 40 are integrally formed with each other, and the second connection portion 31 and the clamp member 40 are integrally formed with each other.

FIGS. 9 to 12 show the third embedment, wherein the first jaw 20 and the body 10 are integrally formed with each other. The fixing member 90 extends through the first hole 14, and the second jaw 30 is restricted by the fixing member 90 and is located in the first recess 11.

The advantages of the present invention are that the fixing member 90 restricts the fixing member 90 in the first recess 11, so that the second jaw 30 can only move linearly in the first recess 11.

As shown in FIGS. 4 to 7, by using the adjustment member 80, the distance between the two clamp members 40 can be adjusted to clamp the objects 92 of different sizes.

When the object 92 is normally clamped by the pipe wrench. The first link 60 is released and the pipe wrench does not need to remove from the object 92 completely, the pipe wrench can be rotated an angle to re-clamp the object 92 like using a ratchet wrench.

While we have shown and described the embodiment in accordance with the present invention, it should be clear to those skilled in the art that further embodiments may be made without departing from the scope of the present invention.

What is claimed is:

1. A pipe wrench comprising:

a body having a first recess defined in a top thereof, the body having an open end defined in a first end thereof, and a closed end formed at a second end thereof, a first contact portion located at the closed end, the body having two sidewalls and a first contact face connected between the two sidewalls, the first recess defined between the two sidewalls and the first contact face, a first aperture defined through each of the two sidewalls and located close to the open end, a threaded hole defined through the first contact portion;

a first jaw being an L-shaped jaw and having a first end fixed to the body, a portion of the first jaw located in the first recess, a second end of the first jaw connected with a first connection portion;

a second jaw having a second connection portion at a first end thereof, a first pivotal portion formed on a second end of the second jaw, a second contact face being defined at an underside of the second jaw, the second jaw slidably received in the first recess and located beneath the first jaw, the second contact face being in contact with the first contact face, the second jaw having a second recess defined in a top thereof, a second aperture defined through each of two sidewalls of the second recess, the second apertures communicating with the second recess;

at least one clamp members connected to the first connection portion or the second connection portion;

a first pin extending through the second apertures of the second jaw;

a second pin extending through the first apertures of the body;

a resilient member located in the second recess and connected between the first pin of the second jaw and the second pin of the body so that the second jaw is moved linearly in the first recess;

a first link having a second pivotal portion and a second contact portion on two ends thereof, a third pivotal portion formed at a mediate portion of the first link, the second pivotal portion being pivotally connected to the first pivotal portion, the second contact portion contacting the first contact portion;

a second link slidably located in the first recess, a fourth pivotal portion and an end face respectively formed on two ends of the second link, the fourth pivotal portion being pivotably connected to the third pivotal portion, a protrusion extending from a lower edge of the end face and contacting the first contact face, and an adjustment member threadedly connected to the threaded hole and having a head and a threaded shank extending from the head, the threaded shank having a distal end which contacts the end face of the second link, the protrusion being restricted by the distal end of the adjustment member, the end face of the second link contacting the first contact face, the head protruding from the body.

2. The pipe wrench as claimed in claim 1, wherein the first pin is tightly connected to the two second apertures, the second pin is tightly connected to the two first apertures.

3. The pipe wrench as claimed in claim 1, wherein the first connection portion has a first slot which is defined by two sidewalls, one of the two sidewalls of the first slot has multiple first connection holes which communicate with the first slot.

4. The pipe wrench as claimed in claim 3, wherein the second connection portion has a second slot which is defined by two sidewalls, one of the two sidewalls of the second slot has multiple second connection holes which communicate with the second slot.

5. The pipe wrench as claimed in claim 4, wherein there are two clamp members each are a T-shaped member, each clamp member has a third connection portion extending from a first face thereof, the two respective third connection portions of the two clamp members are connected to the first and second slots, each of the third connection portions has multiple third connection holes, multiple connectors extend through the aligned first and third connection holes and the aligned second and third connection holes to connect the clamp members to the first and second connection portions respectively.

6. The pipe wrench as claimed in claim 5, wherein the first and second connection holes are threaded holes, the connectors are bolts.

7. The pipe wrench as claimed in claim 1, wherein each clamp member has a toothed face formed on a second face thereof, the second face is located in opposite to the first face, each of the toothed faces has multiple transverse teeth.

8. The pipe wrench as claimed in claim 1, wherein a pin extends through the first and second pivotal portions, another pin extends through the third and fourth pivotal portions.

9. The pipe wrench as claimed in claim 1, wherein the first connection portion and the clamp member are integrally formed with each other.

10. The pipe wrench as claimed in claim 1, wherein the second connection portion and the clamp member are integrally formed with each other.

11. The pipe wrench as claimed in claim 1, wherein the two sidewalls of the first recess of the body each have multiple first holes defined therethrough, the first holes are located close to the open end, the first jaw has multiple second holes which are located in alignment with the first holes, a fixing member extends through each set of the aligned first and second holes to connect the first jaw to the body.

12. The pipe wrench as claimed in claim 1, wherein the two sidewalls of the first recess of the body each have two first holes defined therethrough, the two first holes are located close to the open end, a fixing member extends through the two first holes, the first jaw and the body are integrally formed with each other, the second jaw is restricted by the fixing member and located in the first recess.

* * * * *